US006821044B1

(12) United States Patent
Podejko

(10) Patent No.: US 6,821,044 B1
(45) Date of Patent: Nov. 23, 2004

(54) CONTAINER HAVING A SPRING-BIASED CAP

(76) Inventor: T. Bruce Podejko, 23 N. 7th Ave., Manville, NJ (US) 08835-1507

( * ) Notice: Subject to any disclaimer, the term of this patent is extended or adjusted under 35 U.S.C. 154(b) by 0 days.

(21) Appl. No.: 10/681,425

(22) Filed: Oct. 9, 2003

(51) Int. Cl.[7] ..... A46B 11/00
(52) U.S. Cl. ..... 401/127; 401/126; 401/129
(58) Field of Search ..... 401/118, 121, 401/122, 126, 127, 128, 129, 130; 132/216, 317

(56) References Cited

U.S. PATENT DOCUMENTS 2,847,139 A 8/1958 Christiansson et al.
3,337,901 A * 8/1967 Schefer et al. ..... 401/129
3,341,044 A 9/1967 Valk
D260,369 S 8/1981 Massey
D271,750 S 12/1983 Karosi
5,116,154 A * 5/1992 Fulkerson ..... 401/127
5,158,123 A 10/1992 Senko
5,165,572 A 11/1992 Bath
6,164,857 A * 12/2000 Wolfarth-Brooks et al. 401/127

* cited by examiner

*Primary Examiner*—David J. Walczak
(74) *Attorney, Agent, or Firm*—Donald R. Schoonover

(57) ABSTRACT

A liquid container has a cap that has a brush mounted thereon. The brush is spring-biased to move into liquid-contacting position and can move so the bristles of the brush will be in contact with the liquid in the container whenever the cap is associated with the container.

2 Claims, 3 Drawing Sheets

CONTAINER HAVING A SPRING-BIASED CAP

BACKGROUND OF THE INVENTION

1. Field of the Invention

The present invention relates to the general art of bottles and jars, and to the particular field of closures for bottles and jars.

2. Discussion of the Related Art

Many products, such as nail polish, adhesive, and the like, require a brush for use. These products are often marketed in containers which include a brush attached to a cap for the container. A user dips the brush into the product, removes the product-laden brush from the container, and applies the product using-the brush. Accordingly, the art contains many examples of containers having caps with brushes attached thereto.

Many such containers are cumbersome to use. The container must be balanced and oriented so the cap-mounted brush can be placed in contact with the liquid contained in the container. This can be especially difficult and onerous when nail polish is being applied as a user may not be able to use both hands to orient and balance the container. Often, a user may wish to attend to other tasks during the application process. In such cases, the user must place the brush on a suitable support. However, the brush is generally covered with liquid and thus the support must be suitable. For example, during the application of nail polish, a user may want to place the brush back into the bottle. It would be very helpful if the brush so placed could be placed in contact with the liquid in the container between uses.

Therefore, there is a need for a cap-type liquid container which uses a brush applicator mounted on the cap that will maintain the brush in contact with the liquid whenever the cap of the container is associated with the container.

Often, when the liquid in a container is nearly depleted, the brush on the cap will not reach the liquid so a user must tilt the container to place the brush in contact with the liquid. This is generally cumbersome and can be even more cumbersome if the user cannot fully use his or her hands to balance the container and move the brush. This situation may occur when a user is applying nail polish.

Therefore, there is a need for a cap-type liquid container which uses a brush applicator mounted on the cap that will maintain the brush-in contact with the liquid whenever the cap of the container is associated with the container, even when the liquid in the container is nearly all used up.

PRINCIPAL OBJECTS OF THE INVENTION

It is a main object of the present invention to provide a cap-type liquid container which uses a brush applicator mounted on the cap that will maintain the brush in contact with the liquid whenever the cap of the container is associated with the container.

It is another object of the present invention to provide a cap-type liquid container which uses a brush applicator mounted on the cap that will maintain the brush in contact with the liquid whenever the cap of the container is associated with the container, even when the liquid in the container is nearly all used up.

SUMMARY OF THE INVENTION

These, and other, objects are achieved by a liquid container which comprises a bottle unit which includes a tubular side wall having an inner surface and an outer surface, an external thread on the outer surface of the side wall, and an annular shoulder on the inner surface of the side wall; a brush unit which includes a brush unit body having a proximal end and a distal end, a bristle unit on the distal end of the body of the brush unit, a spring-accommodating cup on the proximal end of the body of the brush unit, and a detent element on the spring-accommodating cup; a cap unit which includes a tubular wall having an internal surface and an external surface and an external screw thread on the outer surface of the tubular wall of the cap unit, and a stem having a detent element-accommodating notch defined therein; the spring-accommodating cup being in abutting contact with the annular shoulder when the brush unit is associated with the bottle unit; and a spring interposed between the stem and the spring-accommodating cup and biasing the brush unit away from the bottle unit, the detent element being received in the detent element-accommodating notch to prevent separation of the cap unit from the brush unit.

The liquid container is suitable for use with nail polish, adhesive, or any other liquid product that can be applied using a brush. Therefore, while nail polish is specifically mentioned in this disclosure, it is understood that the liquid container embodying the present invention can be used for other such uses as well and no limitation as to nail polish is intended.

The liquid container embodying the present invention biases the brush into a position that maintains the bristles thereof in contact with the liquid in the bottle whenever the brush is associated with the bottle. When the cap is screwed onto the bottle, the spring is compressed so the bristles of the brush remain in contact with the liquid in the bottle but are not overly-compressed. However, as the cap is unscrewed, the spring forces the brush out so even if the cap simply rests on top of the bottle, the brush will be in an extended position so the bristles will remain in contact with the liquid in the bottle. This will occur even if there is very little liquid left in the bottle. The notch/detent combination will permit the brush to move into the cap as the cap is screwed onto the bottle, yet will also prevent the separation of the brush from the cap. The spring bias exerted on the brush will hold the brush stable during use.

BRIEF DESCRIPTION OF THE DRAWING FIGURES

DETAILED DESCRIPTION OF THE PREFERRED EMBODIMENT

Figure 1:
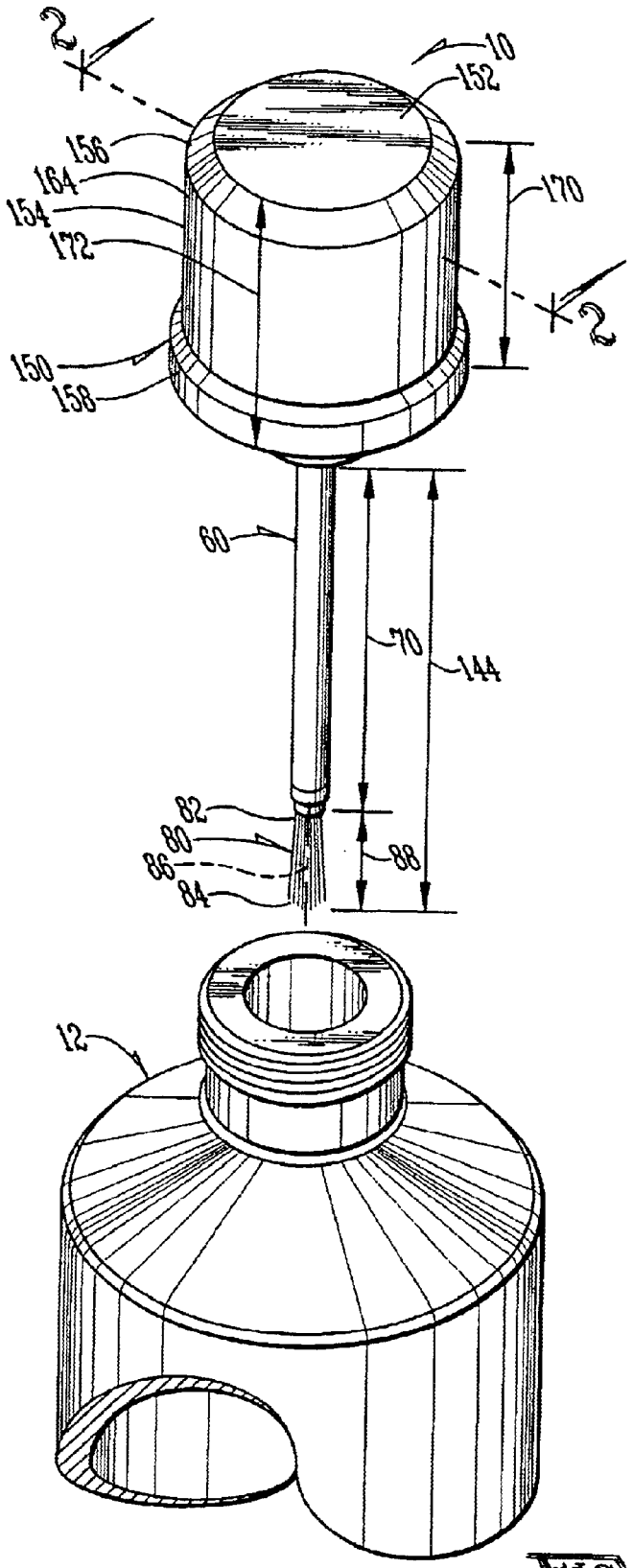
FIG. 1 is a perspective view showing the liquid container embodying the present invention with the cap unit spaced apart from the bottle unit.

Other objects, features and advantages of the invention will become apparent from a consideration of the following detailed description and the accompanying drawings.

Referring to the Figures, it can be understood that the present invention is embodied in a liquid container 10. Liquid container 10 comprises a bottle unit 12 that can contain liquid, such as nail polish, or the like. Bottle unit 12 includes a base end 14, a cylindrical side wall 16 which has a first end 18 which is unitary with the base end 14, a second end 20, and a longitudinal axis 22 which extends between the base end 14 and the second end 20. A blind-ended bore 24 extends between the base end 14 and the second end 20, and an inner surface 26 of the bottle unit 12 is located on the side wall 16 adjacent to the blind-ended bore 24. The inner surface 26 on the side wall 16 has an internal dimension 28. The bottle unit 12 further includes a rim 30 on the second end 20.

The bottle unit 12 further includes an outer surface 32 on the cylindrical side wall 16, with the outer surface 32 of the cylindrical side wall 16 having an external dimension An external screw thread 36 is located on the outer surface 32 of the cylindrical side wall 16. The external screw thread 36 extends from adjacent to the rim 30 toward the base end 14.

An annular shoulder 40 is located on the inner surface 26 of the cylindrical side wall 16 adjacent to and spaced apart from the rim 30. The annular shoulder 40 extends from the inner surface 26 of the cylindrical side wall 16 toward the longitudinal axis 22 and has an opening 42 which is centered on the longitudinal axis 22. The annular shoulder 40 further includes a first surface 44 and a second surface 46. The first surface 44 is located closer to the rim 30 than the second surface 46 and the second surface 46 is located closer to the base end 14 than the first surface 44. The opening 42 of the annular shoulder 40 has a diametric dimension 48.

The bottle unit 12 has an internal lengthwise dimension 50 which is measured between the first surface 44 of the annular shoulder 40 and the base end 14 of the bottle unit 12.

A brush unit 60 is located inside the blind-ended bore 24 when in use. The brush unit 60 includes a brush unit body 62 which has a distal end 64, a proximal end 66, and a longitudinal axis 68 which extends between the distal end 64 of the brush unit body 62 and the proximal end 66 of the brush unit body 62. The longitudinal axis 68 of the brush unit body 62 is co-incident with the longitudinal axis 22 of the bottle unit 12 when the brush unit body 62 is accommodated in the blind-ended bore 24 of the bottle unit 12. The brush unit body 62 has a length dimension 70 measured along the longitudinal axis 68 of the brush unit body 62 between the distal end 64 of the brush unit body 62 and the proximal end 66 of the brush unit body 62.

A bristle unit 80 is located on the distal end 64 of the brush unit body 62. The bristle unit 80 has a proximal end 82 fixed to the distal end 64 of the brush unit body 62 and a distal end 84 spaced apart from the distal end 64 of the brush unit body 62. The bristle unit 80 further includes a longitudinal axis 86 which extends between the distal end 84 of the bristle unit 80 and the proximal end 82 of the bristle unit 80. The bristle unit 80 has a length dimension. 88 which is measured along the longitudinal axis 86 of the bristle unit.80 between the proximal end 82 of the bristle unit 80 and the distal end 84 of the bristle unit 80.

A spring-accommodating cup 90 is located on the proximal end 66 of the brush unit body 62. The spring-accommodating cup 90 includes a base end 92 that is unitary with the proximal end 66 of the brush unit body 62 and which extends transversely to the longitudinal axis 68 of the brush unit body 62. The base end 92 has an outer periphery 94 and an outer peripheral dimension 96. The outer peripheral dimension 96 of the base end 92 of the spring-accommodating cup 90 is larger than the diametric dimension 48 of the annular shoulder 40 of the bottle unit 12.

Cup 90 further includes cylindrical side wall 100 which has an inner surface 102 and an outer surface 104. The outer surface 104 of the cylindrical side wall 100 of the spring-accommodating cup 90 has an outer dimension 106. The outer dimension 106 of the cylindrical side wall 100 of the spring-accommodating cup 90 is smaller than the internal dimension 28 of the inner surface 26 of the side wall 16 of the bottle unit 12. The inner surface 102 of the cylindrical side wall 100 of the spring-accommodating cup 90 has an inner dimension 108.

Cup 90 further includes a rim 110 on the cylindrical side wall 100 of the spring-accommodating cup 90 spaced apart from the base end 92 of the spring-accommodating cup 90.

A longitudinal axis 112 of cup 90 extends between the rim 110 on the-cylindrical side wall 100 of the spring-accommodating cup 90 and the base end 92 of the spring-accommodating cup 90. The longitudinal axis 112 of the spring-accommodating cup 90 is co-linear with the longitudinal axis 68 of the brush unit body 62.

A blind-ended bore 120 is defined between the inner surface 102 of the cylindrical side wall 100 of the spring-accommodating cup 90 and the base end 92 of the spring-accommodating cup 90.

An annular detent element 130 is located on the inner surface 102 of the cylindrical side wall 100 of the spring-accommodating cup 90. The detent element 130 is located adjacent to and spaced from the rim 110 of the cylindrical side wall 100 of the spring-accommodating cup 90. The detent element 130 includes a shoulder 132 which extends radially from the inner surface 102 of the cylindrical side wall 100 of the spring-accommodating cup 90 toward the longitudinal axis 112 of the spring-accommodating cup 90. The shoulder 132 of the detent element 130 has a proximal end 134 unitary with the inner surface 102 of the side wall 100 of the spring-accommodating cup 90 and a distal end 136 which is spaced apart from the inner surface 102 of the cylindrical side wall 100 of the spring-accommodating cup 90. The distal end 136 of the detent element 130 defines an annular opening 138 which is centered on the longitudinal axis 112 of the spring-accommodating cup 90. The annular opening 138 of the detent element 130 has an internal dimension 140.

The brush unit body 62 has an overall length dimension 144 which is equal to the length dimension 70 of the brush unit body 62 plus the length dimension 88 of the bristle unit 80. The overall length dimension of the brush unit body 62 is greater than the internal lengthwise dimension 50 of the bottle unit 12.

Figure 2:
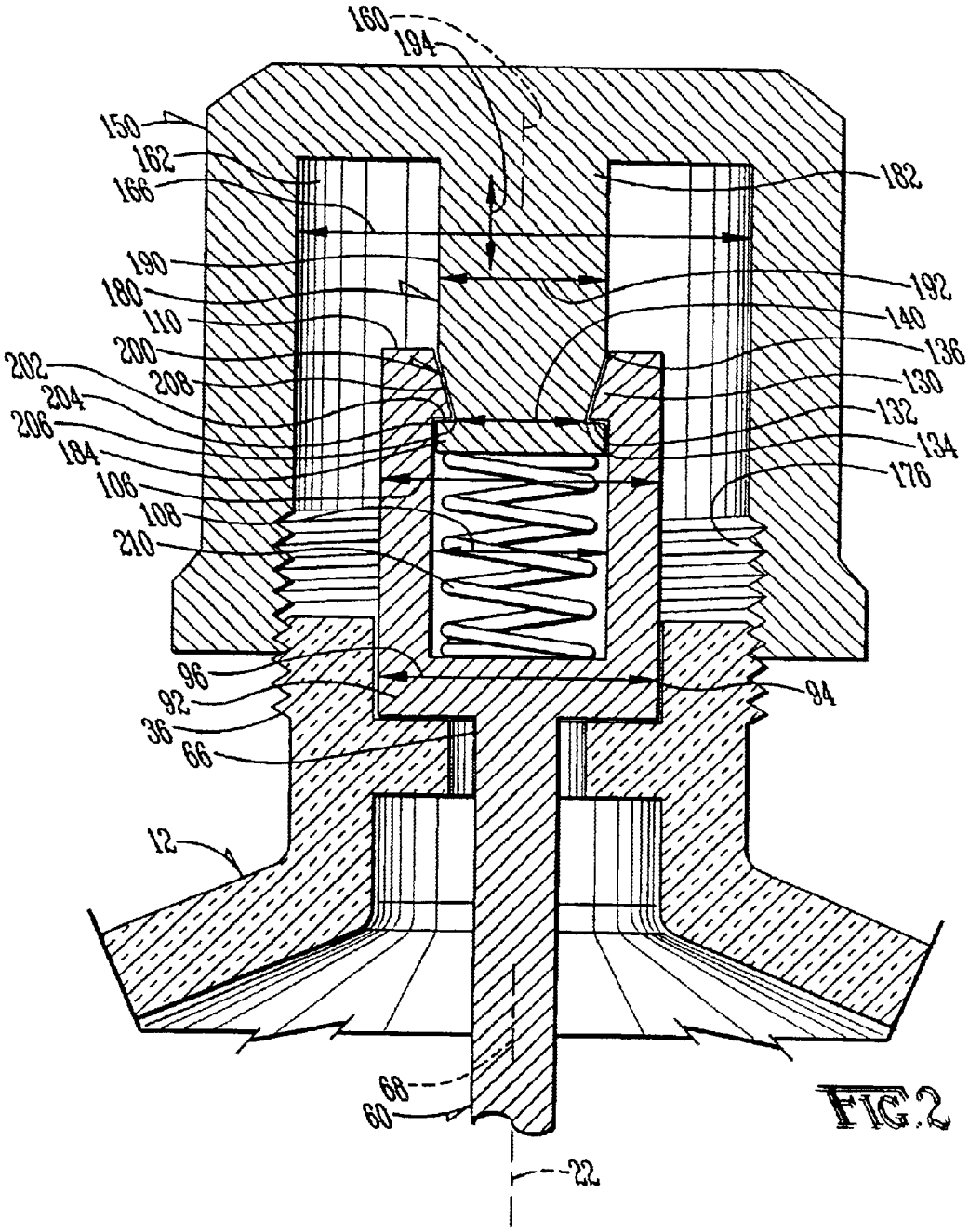
FIG. 2 is an enlarged and fragmentary view taken along line 2—2 of FIG. 1 and which shows the cap unit partially mounted on the bottle unit.
Figure 3:
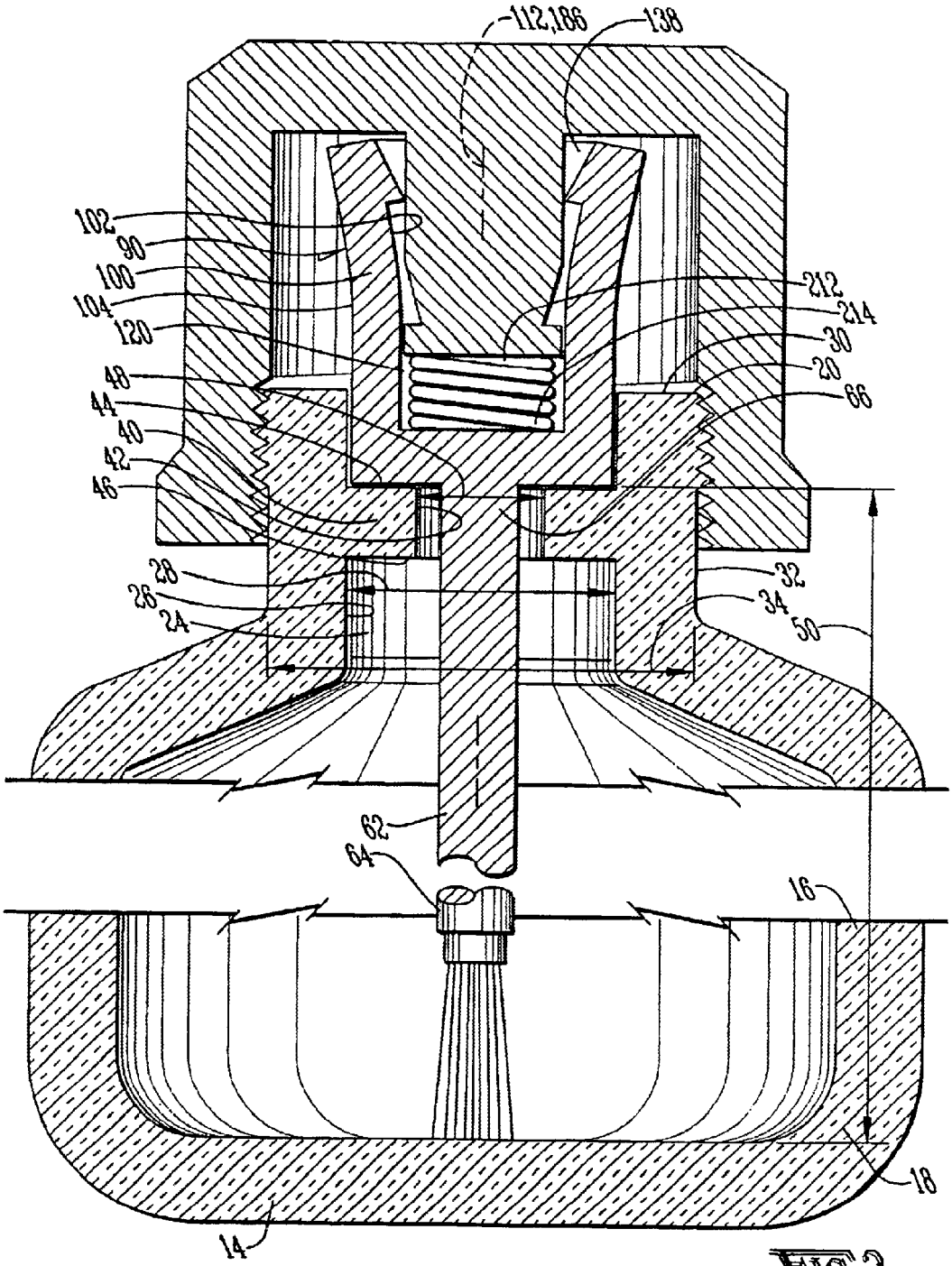
FIG. 3 is an enlarged view similar to FIG. 2, but with the cap unit fully mounted on the bottle unit.

As can be seen in FIGS. 2 and 3, the spring-accommodating cup 90 is in abutting contact with the annular shoulder 40 when the brush unit 60 is associated with the bottle unit 12.

As can also be understood from FIGS. 2 and 3, the brush unit 60 is movably accommodated by the bottle unit 12 to be movable between a stored position shown in FIG. 3 and a use position shown in FIG. 2. As can be seen in FIG. 3, the bristle unit 80 is in contact with the base end 14 of the bottle unit 12 when the brush unit 60 is in the stored position.

Container 10 further includes a cap unit 150 which includes a distal end wall 152 and a cylindrical side wall 154. The cylindrical side wall 154 of the cap unit 150 includes a first end 156 which is unitary with the distal end wall 152 of the cap unit 150, a rim 158 which is spaced apart from the first end 156 of the cylindrical side wall 154 of the cap unit 150, and a longitudinal axis 160 which extends between the distal end wall 152 of the cap unit 150 and the rim 158 of the cylindrical side wall 154 of the cap unit 150. The cylindrical side wall 154 of the cap unit 150 has an inner surface 162, an outer surface 164, and an internal dimension 166. The internal dimension 166 of the cap unit 150 is greater than the external dimension 34 of the outer surface 32 of the cylindrical side wall 16 of the bottle unit 12. The cylindrical side wall 154 of the cap unit 150 has a length dimension 170 which is measured between the distal end wall 152 of the cap unit 150 and the rim 158 of the cylindrical side wall 154 of the cap unit 150.

The cap unit 150 further includes a length dimension 172 which is measured along the longitudinal axis 160 of the cap unit 150 between the distal end wall 152 of the cap unit 150 and the rim 158 of the cylindrical side wall 154 of the cap unit 150.

The cap unit 150 further includes an internal screw thread 176 on the inner surface 162 of the cylindrical side wall 154 of the cap unit 150. The internal screw thread 176 of the cap unit 150 extends from adjacent to the rim 158 of the cylindrical side wall 154 of the cap unit 150 toward the distal end wall 152 of the cap unit 150. The internal screw thread 176 of the cap unit 150 is sized and configured to threadably engage the external screw thread 36 of the bottle unit 12 to releasably couple the cap unit 150 to the bottle unit 12.

Container 10 further includes a stem element 180 which has a proximal end 182 fixed to the distal end wall 152 of the cap unit 150, a distal end 184 which is spaced apart from the distal end wall 152 of the cap unit 150, and a longitudinal axis 186 which extends between the proximal end 182 of the stem element 180 and the distal end 184 of the stem element 180. The longitudinal axis 186 of the stem element 180 is co-linear with the longitudinal axis 160 of the cylindrical side wall 154 of the cap unit 150. The stem element 180 further includes an outer surface 190 which is spaced apart from the inner surface 162 of the cylindrical side wall 154 of the cap unit 150. The outer surface 190 of the stem element 180 has an outer dimension 192 which is smaller than the inner dimension 108of the cylindrical side wall 100 of the spring-accommodating cup 90. The stem element 180 further including a length dimension 194 which is measured between the proximal end 182 of the stem element 180 and the distal end 184 of the stem element 180. The length dimension 194 of the stem element 180 is less than the length dimension 170 of the cylindrical side wall 154 of the cap unit 150.

A detent element-accommodating notch 200 is defined in the outer surface 190 of the stem element 180 adjacent to the distal end 184 of the stem element 180. The detent element-accommodating notch 200 includes a shoulder 202 having an outer end 204 on the outer surface 190 of the stem element 180 and an inner end 206 spaced apart from the outer end 204 of the shoulder 202 of the detent element-accommodating notch 200 toward the longitudinal axis 186 of the stem 180. The detent element-accommodating notch 200 further includes a sloping surface 208 which extends between the inner end 206 of the shoulder 202 of the detent element-accommodating notch 200 to the outer surface 190 of the stem 180.

The distal end 184 of the stem element 180 is located in the blind-ended bore 120 of the spring-accommodating cup 90.

Container 10 further includes a spring element 210 located in the spring-accommodating cup 90. The spring element 210 has a first end 212 in abutting contact with the distal end 184 of the stem element 180 and a second end 214 in abutting contact with the base end 92 of the spring-accommodating cup 90. The spring element 210 is interposed between the stem element 180 and the base end 92 of the spring-accommodating cup 90 and biases the brush unit 60 away from the distal end wall 152 of the cap unit 150. The detent element 130 of the brush unit 60 engages the detent element-accommodating notch 200 of the cap unit 150 to prevent separation of the brush unit 60 from the cap unit 150. As can be understood from FIGS. 2 and 3, the notch 200 of the cap unit 150 and the detent element 130 of the brush unit 60 are shaped and oriented with respect to each other to permit the brush unit 60 to move toward the distal end wall 152 of the cap unit 150 against the bias of the spring element 210 when the cap unit 150 is screwed onto the bottle unit 12.

To use liquid container 10, a user simply unscrews the cap 150 from the bottle 12 whereupon the spring 210 forces the brush unit 60 and bristle unit 80 downwardly until the detent element 130 snaps into the notch 200 thereby locking the spring-accommodating cup 90 in place. The cap 150 can then be placed on top of the bottle 12 and the bristle unit 80 can reach the entire contents of the bottle 12. When needed, the user simply picks up the cap 150 and uses the bristle unit 80 to apply the contents of the bottle 12 as desired. After completion of the task, the cap 150 is then replaced on the bottle 12 for further use. As the cap 150 is replaced on the bottle 12, the turning of the cap 150 causes the detent element 130 to be disengaged from the notch 200 thereby deactivating the lock function of the spring-accommodating cup 90. As a result, the cup 90 slides upwardly along the stem 180. In so doing, the position of the bristle unit 80 relative to the bottle 12 remains effectively unchanged thereby allowing the bristle unit 80 to remain in contact with the base end 14 of the bottle 12 at all times that the cap 150 is resting or, or is connected to, or is otherwise associated with the bottle 12. As mentioned above, the liquid container 10 embodying the present invention has many applications. For example, liquid container 10 can be used for products such as nail polish, contact cement, and small paint containers intended for "touch up" jobs.

It is understood that while certain forms of the present invention have been illustrated and described herein, it is not to be limited to the specific forms or arrangements of parts described and shown.

What is claimed and desired to be covered by Letters Patent is as follows:

1. A liquid container comprising:

a) a bottle unit which includes (1) a base end, (2) a cylindrical side wall having a first end which is unitary with the base end, (3) a second end, (4) a longitudinal axis extending between the base end and the second end, (5) a blind-ended bore which extends between the base end and the second end, (6) an inner surface on the side wall adjacent to the blind-ended bore, the inner surface on the side wall having an internal dimension, (7) a rim on the second end, (8) an outer surface on the cylindrical side wall, the outer surface of the cylindrical side wall having an external dimension, (9) an external screw thread on the outer surface of the cylindrical side wall, the external screw thread extending from adjacent to the rim toward the base end, and

(10) an annular shoulder located on the inner surface of the cylindrical side wall adjacent to and spaced apart from the rim, the annular shoulder extending from the inner surface of the cylindrical side wall toward the longitudinal axis and having an opening centered on the longitudinal axis, the annular shoulder further including a first surface and a second surface, with the first surface being located closer to the rim than the second surface and the second surface being located closer to the bottom end than the first surface, the opening of the annular shoulder having a diametric dimension;

b) said bottle unit having an internal lengthwise dimension which is measured between the first surface of the annular shoulder and the base end of said bottle unit;

c) a brush unit which is located inside the blind-ended bore when in use, said brush unit including (1) a brush unit body having a distal end, a proximal end, and a longitudinal axis extending between the distal end of the brush unit body and the proximal end of the brush unit body, the longitudinal axis of the brush unit body being co-incident with the longitudinal axis of said bottle unit when the brush unit body is accommodated in the blind-ended bore of said bottle unit, the brush unit body having a length dimension measured along the longitudinal axis of the brush unit body between the distal end of the brush unit body and the proximal end of the brush unit body, (2) a bristle unit on the distal end of the brush unit body, the bristle unit having a proximal end fixed to the distal end of the brush unit body and a distal end spaced apart from the distal end of the brush unit body, and a longitudinal axis which extends between the distal end of the bristle unit and the proximal end of the bristle unit, the bristle unit having a length dimension which is measured along the longitudinal axis of the bristle unit between the proximal end of the bristle unit and the distal end of the bristle unit, (3) a spring-accommodating cup on the proximal end of the brush unit body, the spring-accommodating cup including (A) a base end that is unitary with the proximal end of the brush unit body and which extends transverse to the longitudinal axis of the brush unit body, the base end having an outer periphery and an outer peripheral dimension, the outer peripheral dimension of the base end of the spring-accommodating cup being larger than the diametric dimension of the annular shoulder of said bottle unit, (B) a cylindrical side wall having an inner surface and an outer surface, the outer surface of the cylindrical side wall of the spring-accommodating cup having an outer dimension, the outer dimension of the cylindrical side wall of the spring-accommodating cup being smaller than the internal dimension of the inner surface of the side wall of said bottle unit, the inner surface of the cylindrical side wall of the spring-accommodating cup having an inner dimension, (C) a rim on the cylindrical side wall of the spring-accommodating cup spaced apart from the base end of the spring-accommodating cup, (D) a longitudinal axis extending between the rim on the cylindrical side wall of the spring-accommodating cup and the base end of the spring-accommodating cup, the longitudinal axis of the spring-accommodating cup being co-linear with the longitudinal axis of the brush unit body, (E) a blind-ended bore defined between the inner surface of the cylindrical side wall of the spring-accommodating cup and the base end of the spring-accommodating cup, (F) an annular detent element on the inner surface of the cylindrical side wall of the spring-accommodating cup, the detent element being located adjacent to and spaced from the rim of the cylindrical side wall of the spring-accommodating cup, the detent element including a shoulder which extends radially from the inner surface of the cylindrical side wall of the spring-accommodating cup toward the longitudinal axis of the spring-accommodating cup, the shoulder of the detent element having a proximal end unitary with the inner surface of the side-wall of the spring-accommodating cup and a distal end which is spaced apart from the inner surface of the cylindrical side-wall of the spring-accommodating cup, the distal end of the detent element defining an annular opening centered on the longitudinal axis of the spring-accommodating cup, the annular opening of the detent element having an internal dimension, and (G) the brush unit body having an overall length dimension which is equal to the length dimension of the brush unit body plus the length dimension of the bristle unit, the overall length dimension of the brush unit body being greater than the internal lengthwise dimension of said bottle unit, and (4) the spring-accommodating cup being in abutting contact with the annular shoulder when said brush unit is associated with said bottle unit;

d) said brush unit being movably accommodated by said bottle unit to be movable between a stored position and a use position, with the bristle unit being in contact with the base end of said bottle unit when said brush unit is in the stored position;

e) a cap unit which includes (1) a distal end wall, (2) a cylindrical side wall, the cylindrical side wall of said cap unit including a first end which is unitary with the distal end wall of said cap unit and a rim which is spaced apart from the first end of the cylindrical side wall of said cap unit, a longitudinal axis extending between the distal end wall of said cap unit and the rim of the cylindrical side wall of said cap unit, the cylindrical side wall of said cap unit having an inner surface, an outer surface and an internal dimension, the internal dimension of said cap unit being greater than the external dimension of the outer surface of the cylindrical side wall of said bottle unit, the cylindrical side wall of said cap unit having a length dimension which is measured between the distal end wall of said cap unit and the rim of the cylindrical side wall of said cap unit., (3) a length dimension which is measured along the longitudinal axis of said cap unit between the distal end wall of said cap unit and the rim of the cylindrical side wall of said cap unit, (4) an internal screw thread on the inner surface of the cylindrical side wall of said cap unit, the internal screw thread of said cap unit extending from adjacent to the rim of the cylindrical side wall of said cap unit toward the distal end wall of said cap unit, the internal screw thread of said cap unit being sized and configured to threadably engage the external screw thread of said bottle unit to releasably couple said cap unit to said bottle unit, (5) a stem element having a proximal end fixed to the distal end wall of said cap unit, a distal end spaced apart from the distal end wall of said cap unit, a longitudinal axis extending between the proximal end of the stem element and the distal end of the stem element, the longitudinal axis of the stem element being co-linear with the longitudinal axis of the cylindrical side wall of said cap unit, the stem element further including an outer surface which is spaced apart from the inner surface of the cylindrical side wall of said cap unit, the outer surface of the stem element having an outer dimension, the outer dimension of the stem element being smaller than the inner dimension of the cylindrical side wall of the spring-accommodating cup, the stem element further including a length dimension measured between the proximal end of the stem element and the distal end of the stem element, the length dimension of the stem element being less than the length dimension of the cylindrical side wall of said cap unit, (6) a detent element accommodating notch defined in the outer surface of the stem element adjacent to the distal end of the stem element, the detent element accommodating notch including a shoulder having an outer end on the outer surface of the stem element and an inner end spaced apart from the outer end of the shoulder of the detent element accommodating notch toward the longitudinal axis of the stem, the detent element accommodating notch further including a sloping surface which extends between the inner end of the shoulder of the detent element accommodating notch to the outer surface of the stem, and (7) the distal end of the stem element being located in the blind-ended bore of the spring-accommodating cup; and f) a spring element located in the spring-accommodating cup, the spring element having a first end in abutting contact with the distal end of the stem element and a second end in abutting contact with the base end of the spring-accommodating cup, said spring element being interposed between the stem element and the base end of the spring-accommodating cup and biasing said brush unit away from the distal end wall of said cap unit, the detent element of said brush unit engaging the detent element accommodating notch of said cap unit to prevent separation of said brush unit from said cap unit, the notch of said cap unit and the detent element of said brush unit being shaped and oriented with respect to each other to permit said brush unit to move toward the distal end wall of said cap unit against the bias of said spring element when said cap unit is screwed onto said bottle unit.

2. A liquid container comprising:

a) a bottle unit which includes (1) a tubular side wall having an inner surface and an outer surface, (2) an external thread on the outer surface of the side wall, and (3) an annular shoulder on the inner surface of the side wall;

b) a brush unit which includes (1) a brush unit body having a proximal end and a distal end, (2) a bristle unit on the distal end of the body of the brush unit, (3) a spring-accommodating cup on the proximal end of the body of the brush unit, and (4) a detent element on the spring-accommodating cup;

c) a cap unit which includes (1) a tubular wall having an internal surface and an internal surface and an external screw thread on the inner surface of the tubular wall of the cap unit, and (2) a stem having a detent element accommodating notch defined therein;

d) the spring-accommodating cup being in abutting contact with the annular shoulder when said brush unit is associated with said bottle unit; and e) a spring interposed between the stem and the spring-accommodating cup and biasing said brush unit away from said cap unit, the detent element being received in the detent element accommodating notch to prevent separation of said cap unit from said brush unit.

* * * * *